US008643634B2

(12) United States Patent
Hu

(10) Patent No.: US 8,643,634 B2
(45) Date of Patent: Feb. 4, 2014

(54) CONTROL APPARATUS AND PANEL ASSEMBLY COMPRISING SAID CONTROL APPARATUS

(75) Inventor: Shuo-Hsiu Hu, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 1359 days.

(21) Appl. No.: 11/672,131

(22) Filed: Feb. 7, 2007

(65) Prior Publication Data

US 2008/0084367 A1 Apr. 10, 2008

(30) Foreign Application Priority Data

Oct. 5, 2006 (TW) ..... 95137123 A

(51) Int. Cl.
*G09G 5/00* (2006.01)

(52) U.S. Cl.
USPC ..... 345/211; 345/77; 345/212

(58) Field of Classification Search
USPC ..... 345/76–84, 89–100, 204–215, 690
See application file for complete search history.

(56) References Cited

U.S. PATENT DOCUMENTS

| | | | | |
|---|---|---|---|---|
| 5,434,599 | A | 7/1995 | Hirai et al. | |
| 7,528,812 | B2 * | 5/2009 | Tsuge et al. | 345/78 |
| 2002/0105279 | A1 | 8/2002 | Kimura | |
| 2003/0210212 | A1 * | 11/2003 | Li et al. | 345/76 |
| 2005/0030264 | A1 | 2/2005 | Tsuge et al. | |
| 2005/0225519 | A1 * | 10/2005 | Naugler, Jr. | 345/77 |
| 2006/0012310 | A1 * | 1/2006 | Chen et al. | 315/169.3 |
| 2007/0018925 | A1 * | 1/2007 | Cheng et al. | 345/92 |
| 2007/0146251 | A1 * | 6/2007 | Tsuge et al. | 345/76 |

FOREIGN PATENT DOCUMENTS

| | | | |
|---|---|---|---|
| CN | 1552052 | A | 12/2004 |
| CN | 1753070 | A | 3/2006 |
| TW | 200521940 | A | 7/2005 |

OTHER PUBLICATIONS

Chinese language office action dated Mar. 7, 2008.
Taiwan Office Action mailed Apr. 25, 2011.
English translation of abstract and pertinent parts of CN 1752070 A.
English translation of abstract and pertinent parts of TW 200521940 A.

* cited by examiner

*Primary Examiner* — Vijay Shankar
(74) *Attorney, Agent, or Firm* — McClure, Qualey & Rodack, LLP

(57) ABSTRACT

A control apparatus and a panel assembly are provided. The panel assembly comprises a panel device and a control apparatus. The panel device includes a plurality of organic light emitting diodes and a power system. The control apparatus is configured to control the panel device and includes a drive circuit and an interface. The drive circuit is electrically connected to the panel and is configured to retrieve a parameter of the panel device. The interface is configured to transmit a signal comprising the parameter to the power system so that the power system drives the organic light emitting diodes of the panel under a voltage level determined by the parameter.

14 Claims, 3 Drawing Sheets

CONTROL APPARATUS AND PANEL ASSEMBLY COMPRISING SAID CONTROL APPARATUS

This application claims priority to Taiwan Patent Application No. 095137123 filed on Oct. 5, 2006, the disclosures of which are incorporated herein by reference in their entirety.

CROSS-REFERENCES TO RELATED APPLICATIONS

Not applicable.

BACKGROUND OF THE INVENTION

1. Field of the Invention

The present invention relates to a control apparatus; specifically, it relates to a control apparatus for regulating the brightness of a panel device of an organic light emitting diode display according to the panel characteristics.

2. Descriptions of the Related Art

Since an organic light emitting displays (OLED) has advantages of self-lighting, high luminance, high contrast, and wide viewing angles, more and more studies have focused on this field. There are two types of OLEDs: active matrix organic light emitting diode (AMOLED) displays and passive matrix organic light emitting diode (PMOLED) displays. Using a storage capacitor storing written pixel data, a pixel of an AMOLED display can maintain its original brightness after the pixel has been scanned by a scan line. The pixel of a PMOLED display requires the cooperation of both a scan line and a data line to conduct the pixel for maintaining the original brightness. Since the AMOLED display has the advantage of maintaining the brightness after the pixel has been scanned, current studies mainly focus in this domain.

An AMOLED display determines its brightness according to the current that passes through its OLEDs. By controlling the gate electrode voltage of a coupled thin film transistor (TFT), various grayscale levels can be defined. Since the manufacturing process of the TFT is not stable, some drifting may occur. This means that each of the AMOLED displays may have different brightness levels, even if they are provided with the same driving current. According to experimental measurements, the difference between the brightness levels can be as high as ±25%.

The aforementioned drifting problem can be improved using a stricter processing control to reduce the characteristic drifting of the TFTs. However, this kind of approach degrades the yield rate and increases the cost of the manufacturing process. Another approach is to provide an external power supply with various voltage levels for various panels to achieve the same brightness level. However, external power supplies are designed on printed circuit boards by other suppliers, which can not be adjusted correspondingly when panels are assembled for shipping. As a result, this approach is not an effective way to solve this problem. Consequently, it is important to find a way to prevent non-uniform brightness of the panels that result from the drifting of the TFTs.

SUMMARY OF THE INVENTION

An object of this invention is to provide a control apparatus for regulating a panel device. The panel device comprises a plurality of OLEDs and a power system. The control apparatus comprises a driving circuit and an interface. The driving circuit is connected to the panel device electrically for retrieving a parameter of the panel device. The interface is configured for transmitting a signal comprising the parameter into the power system so that the power system is adapted to drive the OLEDs of the panel device to operate according to a voltage value determined by the parameter.

Another object of this invention is to provide a panel assembly comprising a panel device and a control apparatus. The panel device comprises a plurality of OLEDs and a power system. The control apparatus that is configured for regulating the panel device comprises a driving circuit and an interface. The driving circuit is connected to the panel device electrically for retrieving a parameter of the panel device. The interface is configured for transmitting a signal comprising the parameter into the power system so that the power system is adapted to drive the OLEDs to operate according to a voltage value determined by the parameter.

In this invention, the driving circuit disposed on a panel device is first configured to retrieve the parameters related to the panel. Then, the parameters are transmitted to a power system via an interface. With this design, the power system is aware of the status of the panel device so that an adequate voltage can be further outputted to the OLEDs of the panel device to achieve the same brightness level for each panel device without drifting.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
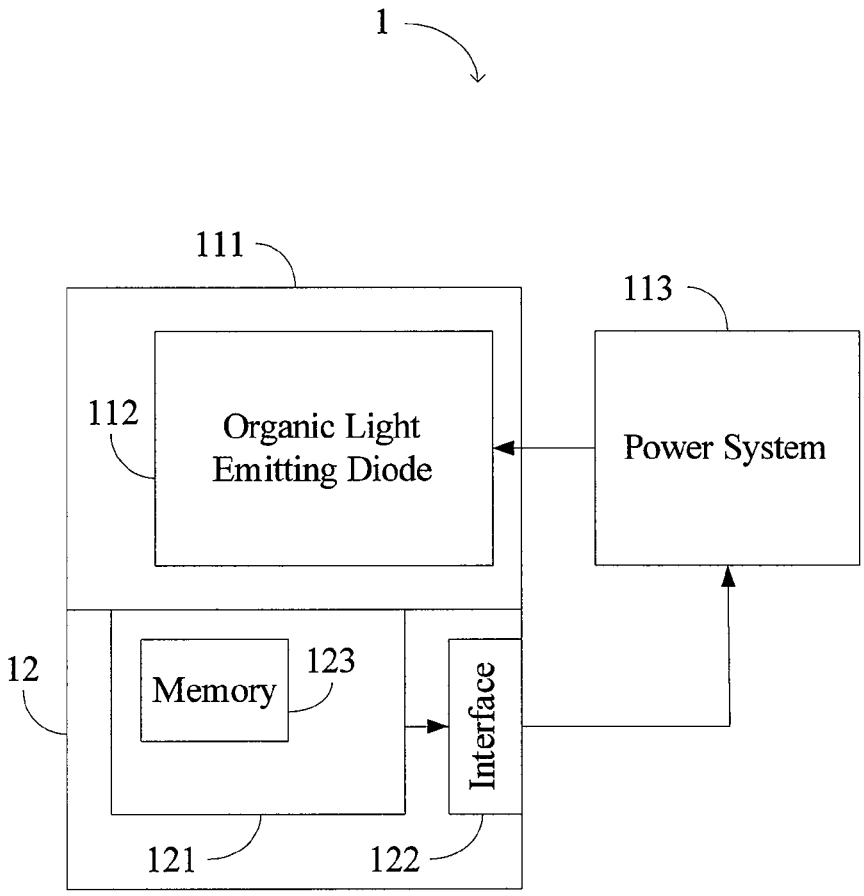
FIG. 1 is a schematic diagram of a first embodiment of this invention.

FIG. 1 shows a schematic diagram of a first embodiment of this invention, which is a panel assembly 1 comprising a panel device and a control apparatus 12 for regulating the panel device. The panel device comprises a panel module 111, a lighting apparatus and a power system 113, wherein the power system is of a digital power system. The panel device comprises a plurality of pixel areas with each of the pixel areas comprising a transistor unit (not shown) and an OLED 112. The OLEDs 112 of the panel device are adapted to define the lighting apparatus. The OLEDs 112 are disposed in the panel module 111, while the power system 113 is disposed on the outside of the panel module 111. In some designs, the power system 113 may be disposed in the panel module 111 with the OLEDs 112.

The control apparatus 12 comprises a driving circuit 121 and an interface 122, wherein the driving circuit 121 further comprises a memory 123. The interface 122 is a digital interface, such as an inter integrated circuit (IIC) or a serial peripheral interface (SPI). After using the panel for a while, the brightness of the panel drops due to the decay of panel components. After detecting a variation in the brightness using a detection device disposed on the panel, a brightness value is saved into the memory 123 of the driving circuit 121. The driving circuit 121 can then dynamically adjust the power system 113 according to the related data pre-stored in the panel to achieve the best display effect.

The driving circuit 121 is electrically connected to the interface 122. The driving circuit 121 converts the parameter into a signal and transmits the signal to the power system 113 via the interface 122, wherein the signal is a digital signal. Consequently, the power system 113 is able to determine a voltage value according to the digital signal to drive the OLEDs 112 electrically connected to the power system 113.

With the design of the first embodiment, the unstable condition of the panel device caused by the manufacturing process can be stored in the memory 123 of the driving circuit 121. That is, the drifting parameters of the OLEDs 112 are stored into the memory 123 and are transmitted to the power system 113 via the interface 122 so that the power system 113 is adapted to drive the OLEDs 112 according to the voltage values determined by the parameter. Since the voltage value is obtained according to the related parameters of the OLEDs 112, the drifting of the brightness levels of the OLEDs 112 can be solved.

Figure 2:
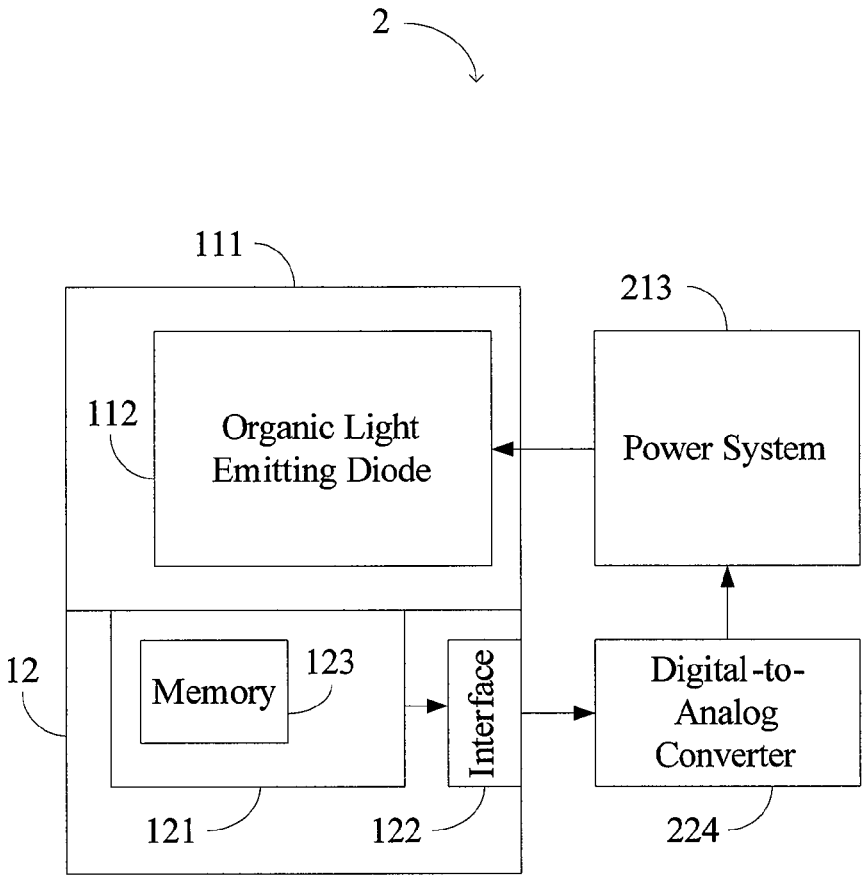
FIG. 2 is a schematic diagram of a second embodiment of this invention.

FIG. 2 shows a schematic diagram of a second embodiment of the invention which is a panel assembly 2. The panel assembly 2 of the second embodiment comprises an extra digital-to-analog (D/A) converter 224 as compared to the panel assembly 1 of the first embodiment. In this embodiment, a power system 213 is a power system that is able to determine analog signals.

The memory 123 of the driving circuit 121 stores a parameter related to the panel device. The interface 122 is required to transmit a signal and the parameter to the power system 213 using the D/A Converter 224. In practice, the D/A Converter 224 is electrically connected to the interface 122 while the power system 213 is in between of them. The interface 122 transmits the signal to the D/A Converter 224. The D/A converter 224 converts the signal into an analog signal and transmits the analog signal to the power system 213. Next, the power system 213 determines an adequate voltage value for reducing the drifting effects to drive the OLEDs 112.

With the arrangement of the second embodiment, not only does it solve the drifting problem in various panel devices, but it also finds an analog system can be chosen as the power system 213, which further reduces the cost.

Figure 3:
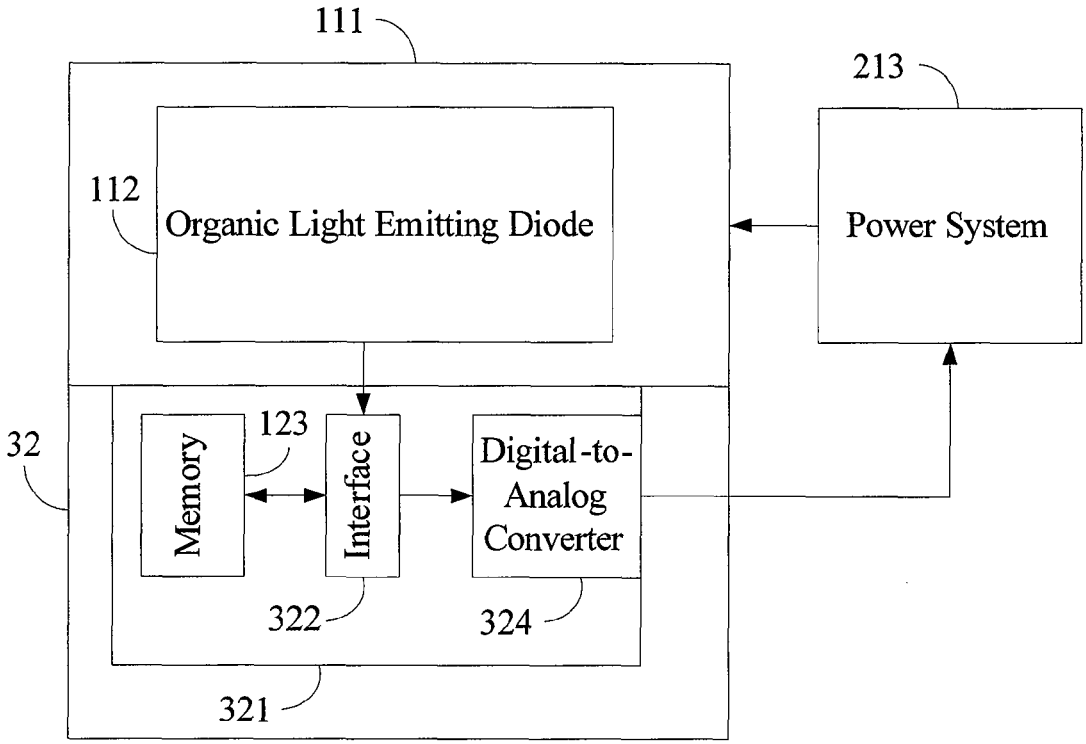
FIG. 3 is a schematic diagram of a third embodiment of this invention.

FIG. 3 shows a schematic diagram of a third embodiment of the invention, which is a panel device applying the control apparatus 32 of the invention. The panel device of the third embodiment is the same as the one mentioned in the second embodiment; therefore, its detailed descriptions are omitted.

The control apparatus 32, configured for controlling the panel device, comprises a driving circuit 321 and an interface 322, wherein the interface 322 is disposed in the driving circuit 321. The driving circuit 321 further comprises a memory 123 and a D/A converter 324. The driving circuit 321 is electrically connected to the panel module 311 for retrieving the parameter of the panel device via the interface 322 and storing the parameter in the memory 123. After retrieving the parameter, the interface 322 transmits a signal and the parameter to the power system 213. More specifically, the interface 322 transmits the signal and the parameter to the D/A converter 324 to convert the signal into an analog signal. The analog signal is then transmitted to the power system 213 for determining an analog voltage according to the parameter to drive the OLEDs 112 of the panel device. The signal transmitted by the interface 322 can be retrieved from the panel device directly or be retrieved from the memory 123.

In addition to having the same advantages as the first embodiment and the second embodiment, the third embodiment also has a smaller size due to the D/A converter 324 being disposed in the driving circuit 321. Note that the memory 123 of the driving circuit 321, the interface 322 and the D/A converter 324 can be combined partially or totally into the driving integrated circuit. Any of these configurations can be implemented in this embodiment.

The above disclosure is related to the detailed technical contents and inventive features thereof. People skilled in this field may proceed with a variety of modifications and replacements based on the disclosures and suggestions of the invention as described without departing from the characteristics thereof. For example, it is also applicable to regulate and handle the voltage transmitted by the power system by another interface, then be sent into the light source of the panel device. Nevertheless, although such modifications and replacements are not fully disclosed in the above descriptions, they have substantially been covered in the following claims as appended.

What is claimed is:

1. A panel assembly, comprising:

a panel device, including a panel module, a lighting apparatus and a power system, the lighting apparatus being disposed in the panel module, the power system being electrically connected to the panel module and disposed out of the panel module; and a control apparatus for regulating the panel device, including:

a driving circuit, being connected to the panel device electrically for retrieving drifting parameters of the panel device, and comprising a memory disposed in the driving circuit for storing the drifting parameters; and an interface, being disposed in the driving circuit for transmitting a signal including the drifting parameters into the power system to dynamically adjust the power system to determine a voltage value so that the power system is adapted to drive the lighting apparatus according to the voltage value determined by the drifting parameters for reducing drifting effects caused by manufacturing processes to the lighting apparatus.

2. The panel assembly of claim 1, wherein the panel device comprises a plurality of pixel areas, each of the pixel areas includes a TFT and an OLED, and the plurality of OLEDs of the panel device are adapted to define the lighting apparatus.

3. The panel assembly of claim 2, wherein the power system is electrically connected to the lighting apparatus.

4. The panel assembly of claim 2, wherein the driving circuit is electrically connected to the interface.

5. The panel assembly of claim 2, wherein the signal is a digital signal and the interface is a digital interface.

6. The panel assembly of claim 5, further comprising a DAC, wherein the interface transmits the signal to the DAC first and then an analog signal corresponding to the signal is outputted to the power system.

7. The panel assembly of claim 2, wherein the driving circuit includes a DAC for converting the signal to an analog signal for entering into the power system.

8. A control apparatus for regulating a panel device, the panel device comprising a panel module, a lighting apparatus and a power system, the lighting apparatus being disposed in the panel module, the power system being electrically connected to the panel module and disposed out of the panel module, the control apparatus comprising:

a driving circuit, being connected to the panel device electrically for retrieving drifting parameters of the panel device, and comprising a memory disposed in the driving circuit for storing the drifting parameters; and an interface, being disposed in the driving circuit for transmitting a signal including the drifting parameters into the power system to dynamically adjust the power system to determine a voltage value so that the power system is adapted to drive the lighting apparatus according to the voltage value determined by the drifting parameters for reducing drifting effects caused by manufacturing processes to the lighting apparatus.

9. The control apparatus of claim 1, wherein the panel device comprises a plurality of pixel areas, each of the pixel areas includes a Thin-Film Transistor (TFT) and an Organic Light Emitting Diode (OLED), and the plurality of OLEDs of the panel device are adapted to define the lighting apparatus.

10. The control apparatus of claim 9, wherein the power system is electrically connected to the lighting apparatus.

11. The control apparatus of claim 9, wherein the driving circuit is electrically connected to the interface.

12. The control apparatus of claim 9, wherein the signal is a digital signal and the interface is a digital interface.

13. The control apparatus of claim 12, further comprising a Digital-to-Analog Converter (DAC), wherein the interface transmits the signal to the DAC first and then an analog signal corresponding to the signal is outputted to the power system.

14. The control apparatus of claim 9, wherein the driving circuit includes a DAC for converting the signal to an analog signal for entering into the power system.

* * * * *